US005183096A

United States Patent [19]

Cook

[11] Patent Number: 5,183,096

[45] Date of Patent: Feb. 2, 1993

[54] METHOD AND APPARATUS FOR SINGLE DIE COMPOSITE PRODUCTION

[76] Inventor: Arnold J. Cook, 372 N. Craig St., Pittsburgh, Pa. 15213

[21] Appl. No.: 493,933

[22] Filed: Mar. 15, 1990

[51] Int. Cl.[5] ..... B22D 19/14

[52] U.S. Cl. ..... 164/97; 164/98; 164/253; 264/328.8; 264/328.15

[58] Field of Search ..... 164/97, 61, 255, 253, 164/103, 105, 76.1, 91, 98; 264/328.8, 328.15

[56] References Cited

U.S. PATENT DOCUMENTS

| | | | |
|---|---|---|---|
| 2,903,389 | 9/1959 | Fujita | 264/328.8 |
| 3,887,411 | 6/1975 | Goodyear | 156/242 |
| 4,158,688 | 6/1979 | Pett | 164/21 |
| 4,312,398 | 1/1982 | Van Blunk | 164/112 |
| 4,318,874 | 3/1982 | Lemelson | 264/328.8 |
| 4,340,109 | 7/1982 | Roddy | 164/103 |
| 4,548,253 | 10/1985 | Funatani | 164/80 |
| 4,653,569 | 3/1987 | Tank | 164/119 |
| 4,749,536 | 6/1988 | Farrell | 264/328.8 |
| 4,766,944 | 8/1988 | Sakuma | 164/97 |
| 4,767,479 | 8/1988 | Ferguson | 156/242 |
| 4,894,197 | 1/1990 | Tsutsumi | 264/328.15 |
| 4,956,316 | 9/1990 | Sawyer | 501/88 |
| 5,007,475 | 4/1991 | Kennedy | 164/97 |

FOREIGN PATENT DOCUMENTS

| | | | |
|---|---|---|---|
| 1966542 | 3/1973 | Fed. Rep. of Germany | 164/155 |
| 62-220263 | 9/1987 | Japan | 164/61 |

*Primary Examiner*—Richard K. Seidel
*Assistant Examiner*—Rex E. Pelto
*Attorney, Agent, or Firm*—Ansel M. Schwartz

[57] ABSTRACT

A method for producing composite materials by forming one material in a die cavity such that another material can be forced into the same die cavity and infiltrate the spaces in the first material. A method for producing a composite comprising the steps of injecting reinforcement material in a binder or suspension into a die cavity; burning off or removing the binder or suspension such that the reinforcement material remains in the die cavity; injecting liquid metal into the same die cavity such that it infiltrates the reinforcement material; solidifying the liquid metal; and removing the metal infiltrated composite material from the die cavity. An apparatus comprised of a die and a die cavity disposed inside the die. The apparatus is also comprised of a first port extending from the die cavity to the surface of the die through which reinforcement material in a binder is injected into a die cavity. Additionally, the apparatus is comprised of a second port extending from the die cavity to the surface of the die through which liquid metal is injected into the same cavity.

18 Claims, 5 Drawing Sheets

METHOD AND APPARATUS FOR SINGLE DIE COMPOSITE PRODUCTION

FIELD OF THE INVENTION

The present invention is related to dies and the production of composites. More specifically, the present invention relates to a method of molding parts in a die that are composed of one or more materials by injection of a discontinuous reinforcement and a metal.

BACKGROUND OF THE INVENTION

Dies are used for the production of a wide range of structures. Typically, when metal matrix composite components are formed, the cavity in the die is loaded by first placing a preheated preform of reinforcing material into the cavity, closing the die and subsequently injecting liquid metal into the cavity and the preform. There are many problems associated with this process—preforms cool while being loaded into the mold and the preform material oxidizes during the transfer from a furnace to the mold, preforms are normally fragile and often break during the loading into the die cavity, and the process requires additional time and equipment to produce the preforms, preheat the preforms, and carefully load the preforms into the die cavity. It would be desirable in order to save time, reduce production problems, and reduce cost to have a method to simplify and control the process variables for the production of metal matrix composites.

The present invention provides for the production of a discontinuously reinforced preform and its injection with metal to produce a metal matrix composite component in the same die cavity. It has a plurality of ports and controls the filling of the cavity, the density of the filling, and the degassing and debindering of material in the cavity.

SUMMARY OF THE INVENTION

The present invention pertains to a method for producing a composite. The method comprises the steps of filling a die cavity with reinforcement material mixed with a binder such that the reinforcement material remains in the die cavity; removing the binder such that the reinforcement material remains in the die cavity; forcing liquid metal into the same die cavity such that it infiltrates into the interstices about the reinforcement material; solidifying the liquid metal; and removing the metal infiltrated composite material from the die cavity.

The present invention also pertains to a method which can be used to produce ceramic and polymer matrix composites in addition to metal matrix composites. The method can be used with existing composite production systems. For example, it can be used with pressure die casting, squeeze casting, and investment casting.

A single die cavity is used to form a composite part by forcing a second phase material into the same die cavity after the first phase material (normally reinforcement material) is forced into the cavity. The first phase material is infiltrated by the second phase material resulting in a composite material. Normally the first phase material is a reinforcement material however other material could be used in either phase to provide properties other than strength such as wear, mechanical, or thermal properties, electrical properties, etc.

The standard method for producing a composite component are done in two ways. Reinforcement material is normally mixed with a binder (this is not always required) then the material is either injected into a preform die or is pressed into a preform die; the resulting preform is then removed from the preform die. The binder may be removed or left in the resulting preform. After the reinforcement has been molded into a preform and the preform has been removed from the preform die, it is normally heated in a furnace and then placed into a different mold, metal is then forced into the preform to form a composite.

The present invention removes the need for two separate dies (a preform die and a die to mold the composite in) and the problems associated with moving the preform from one die to the other. Some of these problems exist because of the brittle nature of many of the reinforcement materials (many of which are ceramic such as alumina, silicon carbide, etc.) and of preforms made of these materials. Other problems exist because of oxidation which occurs when the preform is moved from the preform die to the furnace and then to the die for molding the composite. Oxides can prevent the preform from being infiltrated properly.

The other method currently being used to make composite parts mixes both phases together before forcing them into a die. This is currently being done for low volume fractions, 10–20% of silicon carbide in aluminum. The liquid aluminum must be stirred to keep the SiC particles from settling out of the aluminum. The aluminum containing SiC is then forced into a die to form a composite part. The problem with this method is that it is limited to low volume fractions of reinforcement and reinforcements that will not react to the material it is mixed with.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
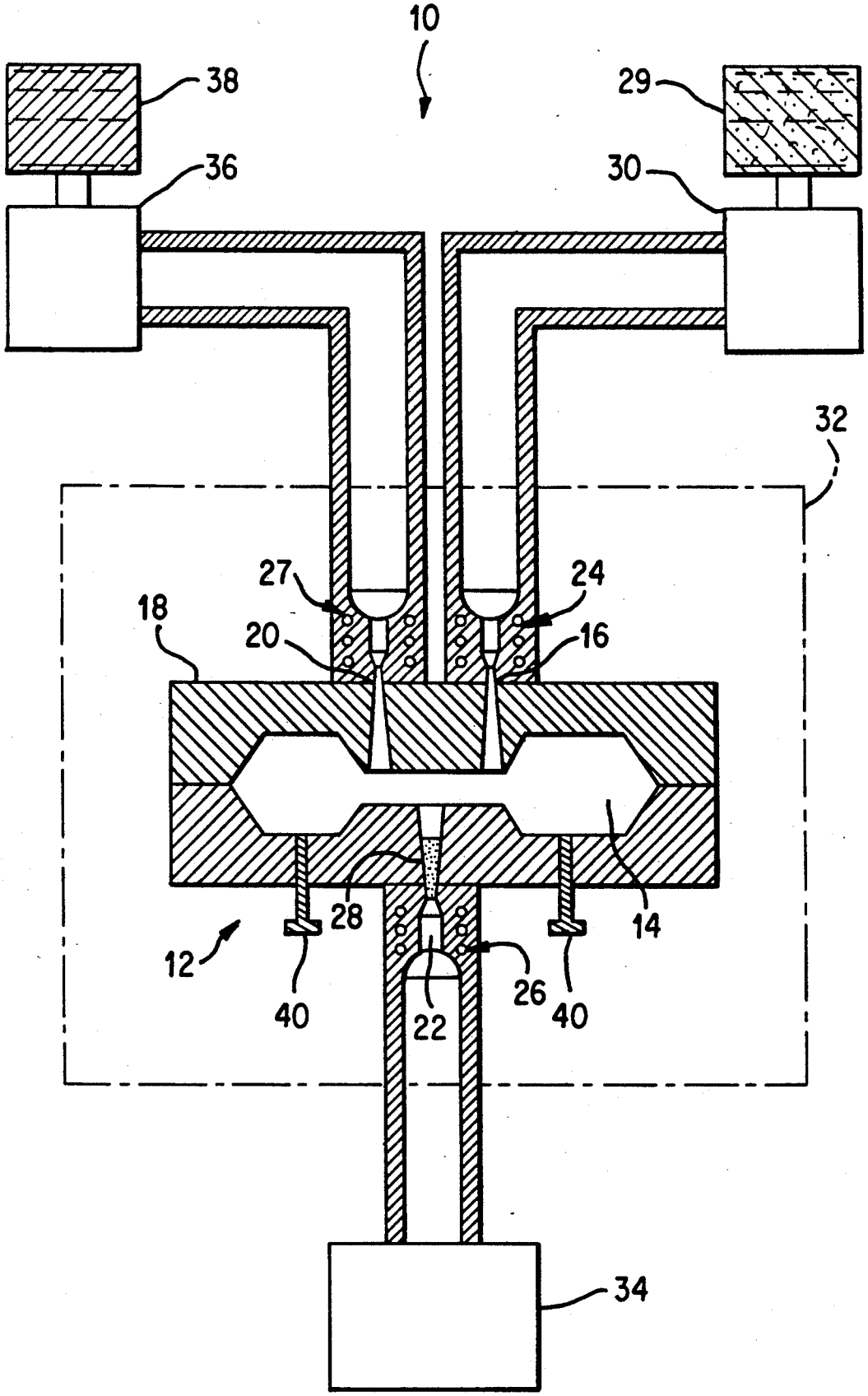
FIG. 1 is a schematic representation of a die.

Referring now to the drawings wherein like reference numerals refers to similar or identical parts throughout the several views, and more specifically to FIG. 1 thereof, there is shown a system 10 that can be used for producing composite material therein by batch or continuous operation. The system 10 is comprised of a die 12 and a die cavity 14 disposed in the die 12. The system 10 is also comprised of a first port 16 extending from the die cavity 14 to the surface 18 of the die 12 through which reinforcement material in a binder is injected into the die cavity 14. The system 10 is also comprised of a second port 20 extending from the die cavity 14 to the surface 18 of the die 12 through which liquid metal is injected into the die cavity 14. The system 10 can also include a third port 22 extending from the die cavity 14 to the surface 18 of the die 12 through which gas or fluid can exit the die cavity 14.

Preferably, the system 10 includes first a means 24 for controlling the temperature of the first port 16 and second means 27 for controlling the temperature of the second port 20. The temperature control means 24 is in thermal communication with the first port and can be, for instance, a jacket of water (not shown) and/or a heating coil (not shown) positioned about the first port 16. The temperature control means 27 is in thermal communication with the second port 20 in an identical manner to the first port 16.

There can also be a second means 26 for chilling the third port 22. The second chilling means 26 is in thermal communication with the third port 22 and is, for instance, a jacket of water (not shown) positioned about the third port 22. Additionally, the system 10 can include a filter 28 (as shown in FIG. 1) disposed in the third port 22 to allow gas to pass therethrough but not reinforcement material.

Figure 2:
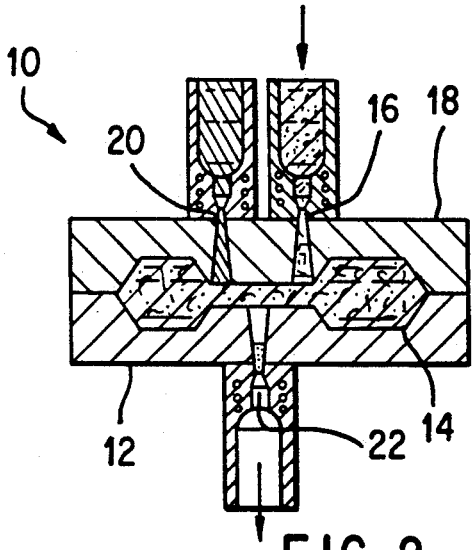
FIG. 2 is a schematic representation of the die being filled with reinforcement.
Figure 6:
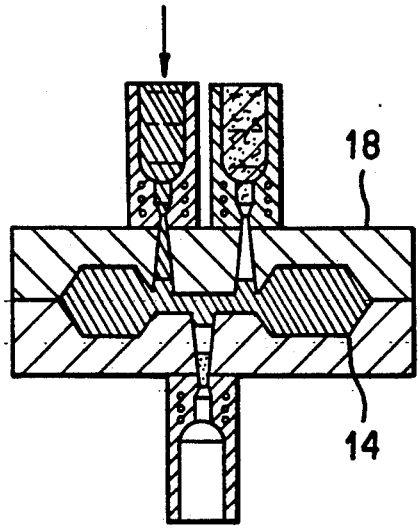
FIG. 6 is a schematic representation of the die with the liquid metal solidified in the die cavity.
Figure 7:
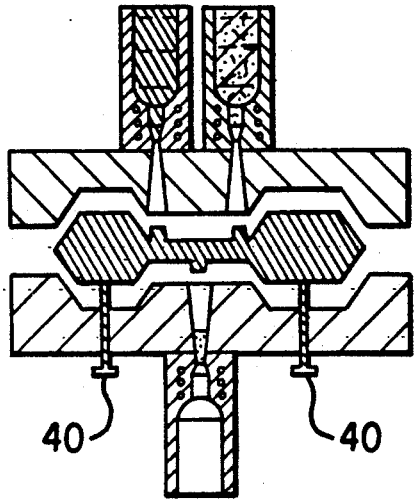
FIG. 7 is a schematic representation of the die being separated to obtain the solidified composite material in the shape of the die cavity.

In this embodiment, a die cast composite component is produced in a single die 12 by a method comprising the steps of: forcing reinforcement material mixed in a binder into the die cavity 14 (see FIG. 2); removing the binder such that the reinforcement material remains in the die cavity 14 (see FIG. 3); forcing liquid metal into the die cavity 14 such that it infiltrates into the interstices of the reinforcement material (see FIGS. 4 and 5); solidifying the liquid metal (see FIG. 6); and removing metal infiltrated composite material from the die cavity 14 (see FIG. 7).

Figure 4:
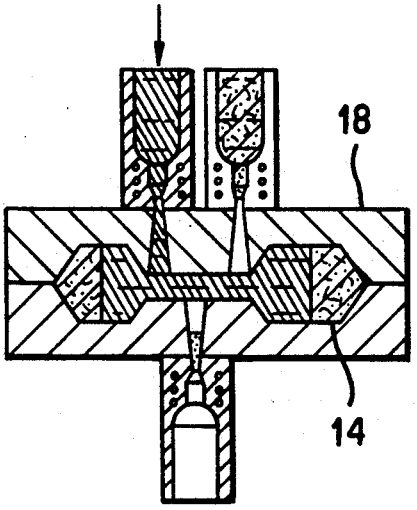
FIG. 4 is a schematic representation of the die with liquid metal injected at low pressure into the die cavity.
Figure 5:
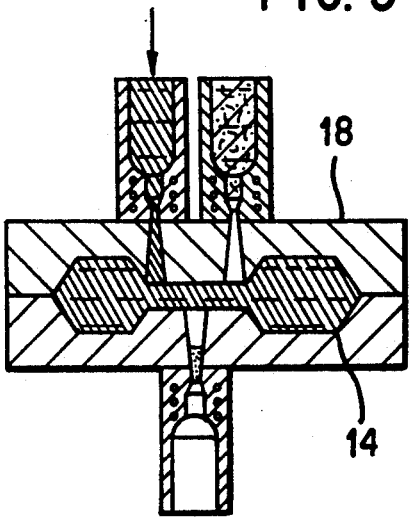
FIG. 5 is a schematic representation of a the die with liquid metal injected into the cavity under increased pressure.

Preferably, the injecting liquid metal step includes the steps of injecting liquid metal into the die cavity 14 at low pressure (see FIG. 4), and increasing the pressure such that the liquid metal infiltrates the reinforcement material (see FIG. 5). The binder may be removed by changing the temperature of the reinforcement containing the binder such the binder is burned off, and an additional step can be added to evacuate the die cavity 14 to eliminate gas pockets in the reinforcement material. Some binders may be removed by vacuum and without a change in temperature. The vacuum can be pulled through the parting between the die halves or out port 22. With a vacuum on the reinforcement, liquid metal does not trap gas in the reinforcement as it penetrates therethrough.

In the operation of the preferred embodiment, a reinforcement material of silicon carbide particles is mixed with a binder such that the resulting mixture is 10 to 85 percent silicon carbide. The binder can be inorganic (such as silica) or organic such as water or paraffin and in this example, a wax binder will be described. The silicon carbide particles are mixed with the wax as individual particles rather than as one solid piece in order to afford fluidity to the wax-particle mixture.

The silicon carbide particles mixed with wax are injected under a pressure of 100–2000 psi pressure, depending on the complexity of the mold and the amount of silicon carbide in the mixture, through the first port 16, as shown in FIG. 1. The silicon carbide particles mixed in the wax are placed under pressure by way of a piston or gas pressure chamber 30 fluidically connected to the first port 16 and to a first supply 29 of silicon carbide wax mixture. The silicon carbide particles mixed in wax pass through the first port 16 into the die cavity 14. This is continued until the die cavity 14 of the die 12 is filled with silicon carbide particles with the mixture at a temperature above the melting point of the wax binder but below the vapor point. Approximately 100° C. to 170° C. can be used with many wax binders.

The silicon carbide and wax mixture is prevented from exiting the die cavity 14 through port 20 by solidified metal in the port or a valve in the liquid metal line (not shown) and blocked by the filter that is sized to prevent mixture from exiting through port 22. The die cavity may be pre-evacuated through port 22 or through the parting between the die parts to assist filling the die cavity 14 with some binder materials.

Figure 3:
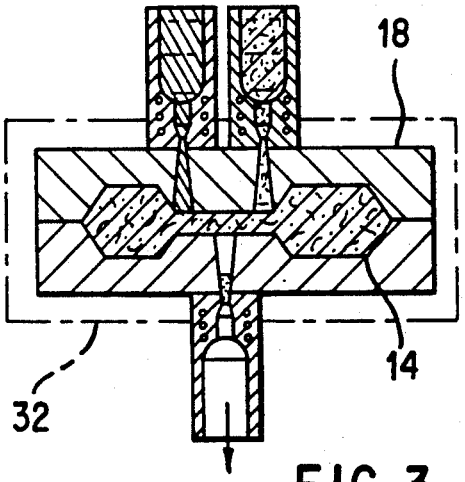
FIG. 3 is a schematic representation of the die with only reinforcement material in its chamber with binder being removed.

At this point, further injection of the mixture is halted and sufficient heat, such as 300°–600° centigrade is provided to the die cavity 14 from heating means 32 causing the wax to vaporize or burn away from the silicon carbide particles as shown in FIG. 3. Evacuation pump 34 (FIG. 1) evacuates the die cavity 14 before, during and after the silicon carbide and wax mixture is injected into the die cavity 14 through first port 16. Gas or fumes that result from the heating of the binder are removed through the third port 22 which has the evacuation pump connected to it. It should be noted that the die 12 may be kept at a temperature above the vapor point of the binder (300°–600° C.), so long as the silicon carbide and wax mixture are injected quickly into the die cavity 14. This helps to reduce the cycle time by removing the need to change the die 12 temperature.

After the wax is burned off and essentially all that remains in the die cavity 14 is the silicon carbide particles, liquid metal is injected through the second port 20 into the die cavity 14. In this example, the liquid aluminum is injected under pressure into the die cavity 14 by a piston or pressure chamber 36 fluidically connected with the second port and also fluidically connected to a second supply 38. The liquid aluminum fills the die cavity 14 and penetrates into the interstices between the silicon carbide particles as shown in FIGS. 4 and 5.

A first temperature control means 24 positioned about the first port 16, such as a water jacket, keeps the first port 15 and the area entering into the port at a lower temperature, normally below 200° C., causing any liquid aluminum that passes into the first port 16 to solidify and form a plug which prevents liquid aluminum from flowing out of the die cavity 14 via the first port 16. Similarly, a third temperature control means 26, such as a third water jacket causes any liquid aluminum passing into the third port 22 from the die cavity 14 to solidify and form a plug. The first temperature control means 24 and the third temperature control means 26 can also serve as an initiation point for solidification. The entrances of all the ports into the die cavity 14 are tapered to allow the any that solidifies in the port to come out easily when the final casting is removed.

The liquid metal is first injected into the die cavity 14 at a low pressure to allow for the solidification plugs to form in the first port 16 and third port 22 as shown in FIG. 4. The liquid metal injection pressure is then increased until the liquid aluminum infiltrates into the interstices of the silicon carbide particles as shown in FIG. 5. Temperature of the metal being injected can be controlled by temperature control means 27 in port 20. The die 12 is normally kept slightly below the melting point of the aluminum.

After the metal is injected, the pressure is maintained as the liquid metal is allowed to solidify as shown in FIG. 6 to fill the shrinkage with additional metal from port 20. Temperature control means 27 may be used to keep metal flowing into the die cavity 14 as the metal solidifies. After the liquid metal is solidified, the die is opened and the metal infiltrated silicon carbide particle component in the shape of the die cavity 14 is removed. Extraction pins 40 may be used to separate the die and remove the aluminum infiltrated silicon carbide reinforced component from the die 12 as shown in FIG. 7.

Figure 11:
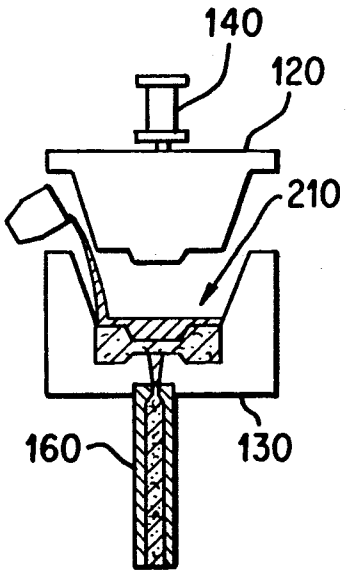
FIG. 11 is a schematic representation of metal being poured on top of reinforcement.
Figure 10:
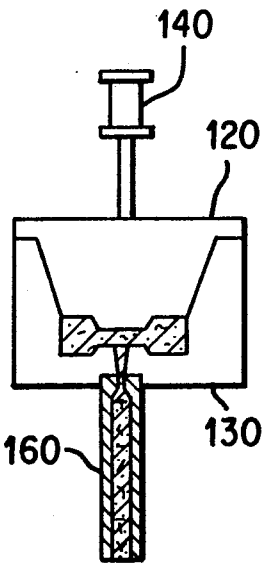
FIG. 10 is a schematic representation of binder being removed from reinforcement.
Figure 9:
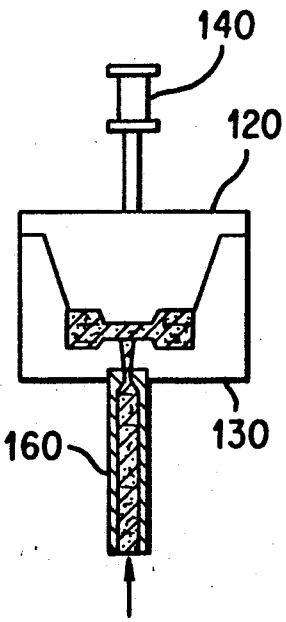
FIG. 9 is a schematic representation of injection reinforcement material.
Figure 8:
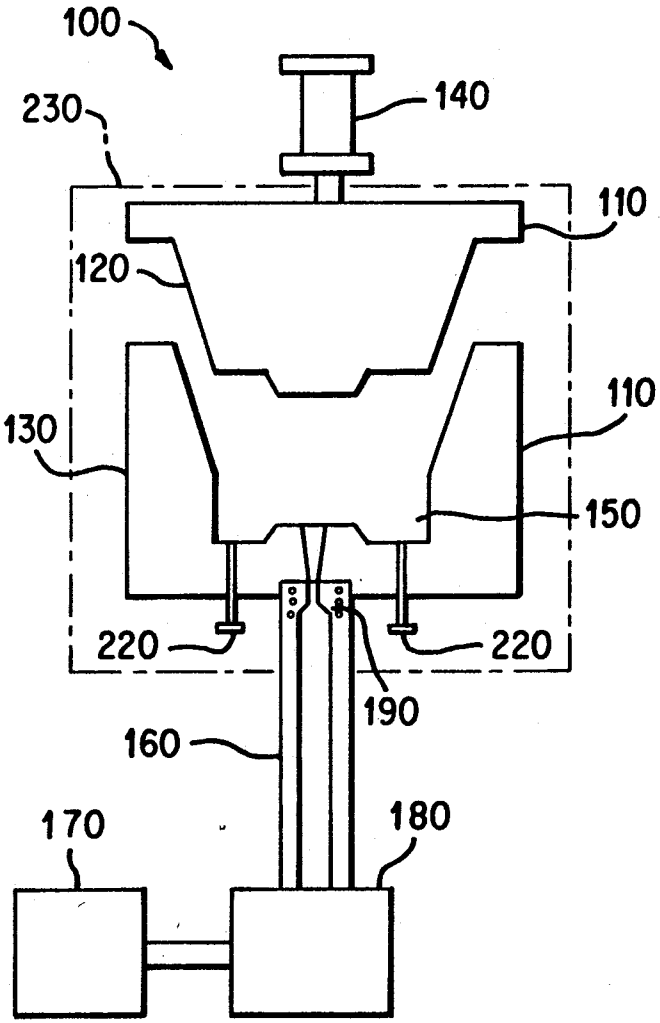
FIG. 8 is a schematic representation of another embodiment for squeeze casting.
Figure 15:
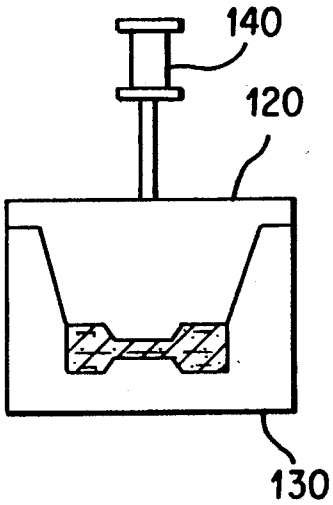
FIG. 15 is a schematic representation of reinforcement material being pressed into the shape of the die to make a preform.
Figure 13:
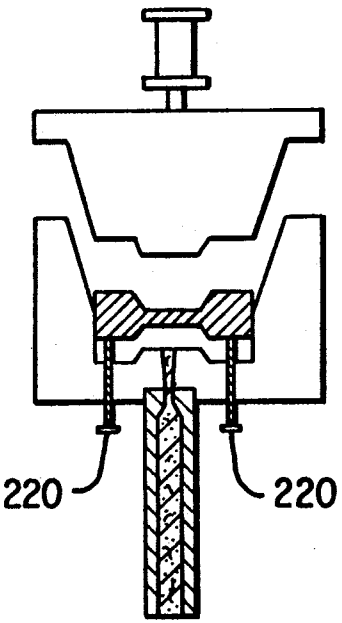
FIG. 13 is a schematic representation of composite part being ejected from die cavity
Figure 12:
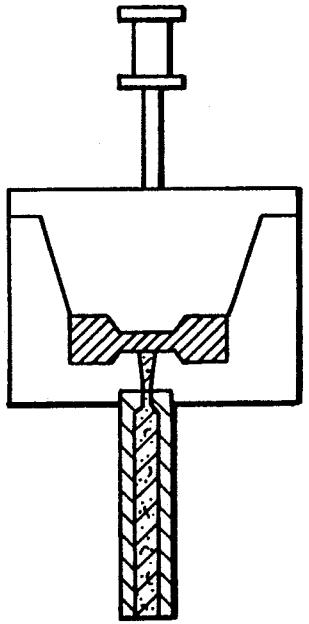
FIG. 12 is a schematic representation of metal being squeezed by the movable die half to fill die cavity and infiltrate reinforcement.

Alternatively, a system 100, as shown in FIG. 8, can be comprised of a die 110, and a die cavity 150. The upper die 120 is connected to a ram 140 which can move the upper die 120 up and down. The lower die 130 is in fluidic connection with port 160. The lower die 130 also has ejector pins 220. Port 160 is connected to a piston or pressure chamber 180 and a supply of reinforcement mixed with a binder 170. A heater 230 controls the die 110 temperature. The same silicon carbide mixed with a wax binder may be used. The ram 140 pushes the upper die 120 together with the bottom die 130. The die cavity 150 is then injected with silicon carbide and wax mixture through port 160, as shown in FIG. 9. The mixture is injected quickly with 100 to 2000 psi. The die 110 is kept at a temperature slightly below the melting point of the metal or material to be injected into the reinforcement, 30020 to 600° C. normally for aluminum. In FIG. 10, the binder is being removed; wax binders burn off and gas can escape through the parting between the mold. A vacuum around the dies 120 and 130 (not shown) or another port connected to a vacuum (not shown) can assist in removing trapped gas. After the reinforcement (silicon carbide particles in this example) are debindered, the upper die 120 is raised with the ram 140 and liquid aluminum is poured on top of the preform (the name for the debindered shape of the reinforcement) as shown in FIG. 11. In FIG. 12, the ram 140 pushes the upper die down, squeezing the liquid aluminum into the preform and the die cavity 150. Liquid metal is prevented from entering into the port 160 because the temperature control means 190, which could contain a water jacket (not shown), causes the metal to solidify and form a plug. Alternatively, a valve (not shown) may be used to stop liquid metal from entering into port 160. After the part has solidified, the upper die 120 is raised by the ram 140 and the ejector pins 220 push out the metal infiltrated silicon carbide composite component with the shape of the die cavity 150, as shown in FIG. 13.

Figure 14:
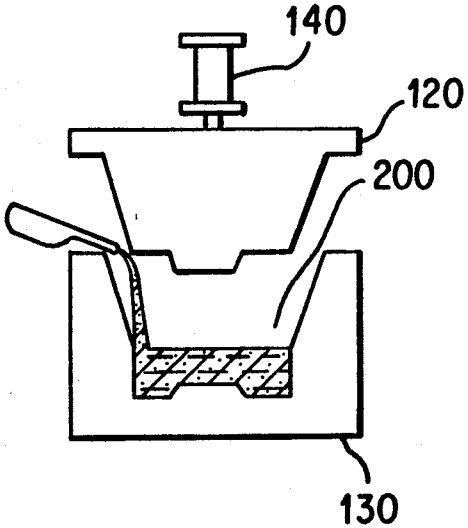
FIG. 14 is a schematic representation of reinforcement material being poured into a die.

It is also possible to pour or inject a silicon carbide particle and wax mixture, with or without a binder, into the bottom die 130 with the upper die 120 lifted as shown in FIG. 14 and then press the mixture into the die cavity 150 with the upper die 120 by lowering the ram 140. The rest of the steps would then follow those described in FIGS. 10 through 13.

Figure 16:
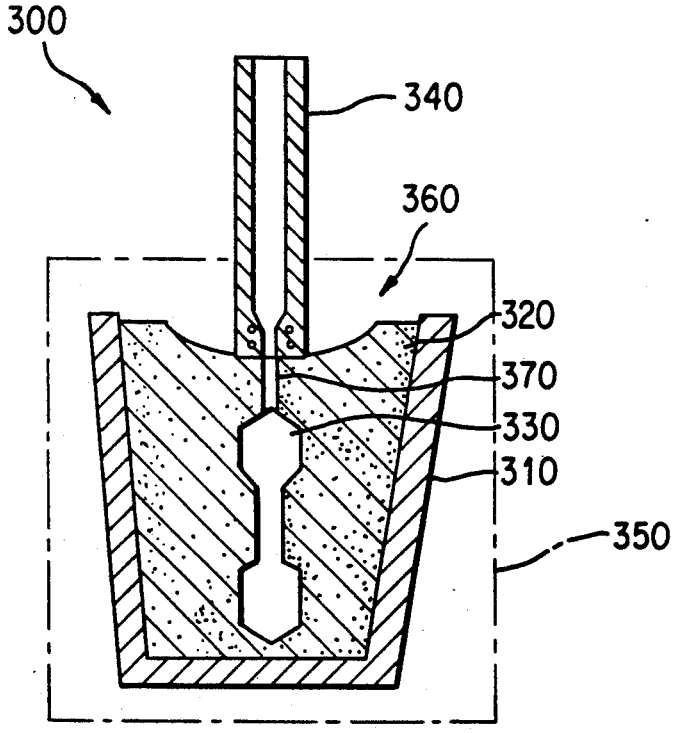
FIG. 16 is a schematic representation of an investment casting system.
Figure 17:
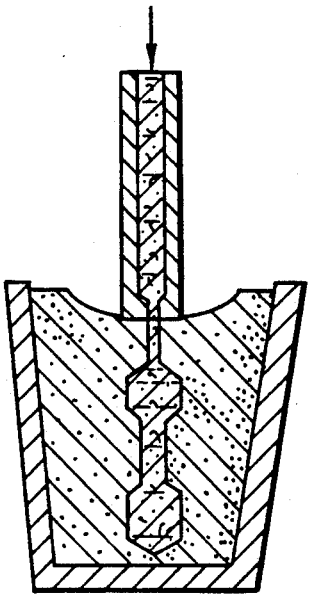
FIG. 17 is a schematic representation of reinforcement being injected into die cavity.
Figure 18:
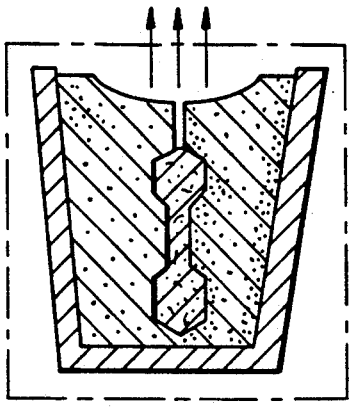
FIG. 18 is a schematic representation of binder being removed from reinforcement.
Figure 19:
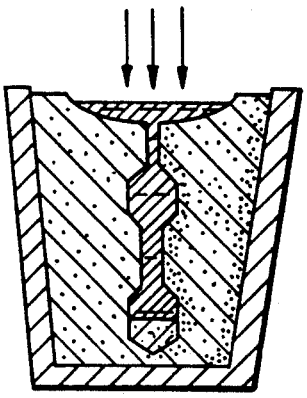
FIG. 19 is a schematic representation of metal being forced into die cavity and reinforcement.

A second alternative, a system 300, as shown in FIG. 16, comprised of an investment die 360 with heating means 350. Investment material 320 is cast with a die cavity 330 in the shape of the desired part by standard investment casting techniques. An injector 340 is then fluidically connected to the investment die 360 and silicon carbide particles and wax mixture are injected into the die cavity 350, as shown in FIG. 17. The investment material can be kept above the vapor point of the binder and slightly below the melting point of the metal to be used, for example 300°-600° C. for aluminum. After injecting, the injector 340 is removed and binder is burned off. Gas may escape through the spru system 370 or through the semi porous walls of the investment material. A vacuum (not shown) may be used to assist the removal of gas from the die cavity 350 and the investment material 320 as shown in FIG. 18. Once all the binder is removed, liquid metal can then be forced into the mold by gas pressurization or other investment casting techniques such as centrifugal casting as shown in FIG. 19. It should be noted that the investment material must be less porous than the reinforcement material or the investment material will infiltrate also.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for producing a metal matrix composite within a single die cavity comprising the steps of:

forcing a reinforcement material mixed with a liquid binder into the die cavity from a first port extending into the die cavity;

removing the binder such that the reinforcement material having interstices disposed about remains in the die cavity;

forcing liquid metal into the die cavity from a second port extending into the die cavity such that the metal infiltrates the interstices about the reinforcement material;

solidifying the liquid metal; and removing the infiltrated composite material from the die cavity.

2. A method as described in claim 1 wherein the forcing liquid metal step includes the steps of injecting liquid metal into the die cavity at a first pressure, and then increasing the pressure such that the liquid metal infiltrates the reinforcement material.

3. A method as described in claim 2 including during the step of removing the binder, the step of evacuating the die cavity.

4. A system for producing a metal matrix component comprising:

a die;

a die cavity disposed in the die;

a first port extending from the die cavity to the surface of the die through which a reinforcement material mixed with a liquid binder is injected into the die cavity;

a second port extending from the die cavity to the surface of the die through which liquid metal is injected into the die cavity; and means for controlling the temperature of the first port such that reinforcement material mixed with a binder can be injected into the die cavity through the first port at a desired temperature and liquid metal injected into the die cavity will solidify and form a solidification plug when it enters the first port, said controlling means in thermal contact with the first port.

5. An apparatus as described in claim 4 including a third port extending from the die cavity to the surface of the die through which gas in the die cavity can exit the die.

6. An apparatus as described in claim 5 including first means for temperature control of the first port, said first temperature control means in thermal communication with the first port; second means for temperature control of the second port, said second temperature control means in thermal communication with second port; and third temperature control means of the third port in thermal communication with the third port; and a filter disposed in the third port to allow gas to pass therethrough but not reinforcement material injected into the die cavity.

7. A system as described in claim 4 having means to remove the binder from the reinforcement material such that the reinforcement material is left behind.

8. A system as described in claim 11 wherein the removing means is a heating means.

9. A system comprising:

a die;

a die cavity disposed in the die and in fluidic communication with the surface of the die;

a channel in fluidic communication with the die cavity;

a first port fluidically connected to the channel through which a reinforcing material mixed with a liquid binder is injected into the die cavity;

a second port connected to the channel through which a liquid metal is forcibly injected into the die cavity; and means for controlling the temperature of the first port such that reinforcement material mixed with a binder can be injected into the die cavity through the first port at a desired temperature and liquid metal injected into the die cavity will solidify and form a solidification plug when it enters the first port, said controlling means in thermal contact with the first port.

10. A system as described in claim 9 including a third port through which gas in the die cavity can be removed.

11. A system as described in claim 10 having means to remove the binder from the reinforcement material such that the reinforcement material is left behind.

12. A system as described in claim 10 wherein the removing means is a heating means.

13. A method for producing a composite in a single die cavity comprising the steps of:

injecting reinforcement material mixed with a liquid binder in the die cavity;

removing the binder such that the reinforcement material having interstices disposed about remains in the die cavity;

forcing liquid metal into the die cavity such that the metal infiltrates the interstices about the reinforcement material;

solidifying the liquid metal; and removing the infiltrated composite material from the die cavity.

14. A system for producing a metal matrix composite comprising:

a die having a die cavity;

means for introducing a reinforcement material mixed with a liquid binder into the die cavity, said introducing means in fluidic communication with said die cavity;

means for removing the binder from the die cavity such that interstices are exposed about the reinforcement, said removing means inc communication with said die cavity; and means for forcibly injecting liquid metal into the same die cavity such that metal infiltrates the interstices about the reinforcement, said injecting means in fluidic communication with said die cavity.

15. A system as described in claim 14 wherein the introducing means includes a gas pressure chamber.

16. A system as described in claim 15 wherein the injecting means includes a gas pressure chamber.

17. A system as described in claim 16 wherein the removing means includes means for heating the binder.

18. A system as described in claim 17 including means for evacuating the die cavity, said evacuating means in fluidic communication with said die cavity.

* * * * *